US006340205B1

(12) United States Patent
Battiston

(10) Patent No.: US 6,340,205 B1
(45) Date of Patent: Jan. 22, 2002

(54) FOLDABLE SEATING DEVICE

(75) Inventor: Joseph Battiston, Chester, VA (US)

(73) Assignee: Tubular Fabricators Industry, Petersburg, VA (US)

( * ) Notice: Subject to any disclaimer, the term of this patent is extended or adjusted under 35 U.S.C. 154(b) by 0 days.

(21) Appl. No.: 09/366,010

(22) Filed: Aug. 2, 1999

Related U.S. Application Data

(63) Continuation of application No. 08/906,729, filed on Aug. 5, 1997, now abandoned.

(51) Int. Cl.[7] ..... A47C 4/00

(52) U.S. Cl. ..... 297/24; 108/119; 248/164; 248/188.8; 297/56

(58) Field of Search ..... 297/24, 312, 53, 297/56; 108/118, 119, 120; 248/164, 432, 439, 188.8

(56) References Cited

U.S. PATENT DOCUMENTS

| | | | | |
|---|---|---|---|---|
| 504,446 A | * | 9/1893 | Dodd | 297/56 |
| 530,564 A | | 12/1894 | Walton | |
| 816,853 A | | 4/1906 | Eisele | |
| 1,027,012 A | | 5/1912 | Stock et al. | |
| 1,283,924 A | | 11/1918 | Rupp | |
| 2,695,829 A | * | 11/1954 | Martinez | 108/118 |
| 2,779,394 A | * | 1/1957 | Csorgo | 108/119 |
| 3,031,243 A | | 4/1962 | Crevoi | |
| 3,106,295 A | * | 10/1963 | Berlin | 108/118 |
| 3,141,425 A | * | 7/1964 | Duer | 108/120 |
| 3,220,764 A | | 11/1965 | Duer | |
| 3,381,998 A | | 5/1968 | Cheshier et al. | |
| 4,656,678 A | | 4/1987 | Lipski | |
| 5,335,604 A | * | 8/1994 | Jiang | 108/118 |

FOREIGN PATENT DOCUMENTS

| | | |
|---|---|---|
| DE | 94 00541 | 2/1994 |
| GB | 292823 | 7/1928 |

* cited by examiner

*Primary Examiner*—Peter M. Cuomo
*Assistant Examiner*—Stephen Vu
(74) *Attorney, Agent, or Firm*—Klauber & Jackson

(57) ABSTRACT

A foldable bench has a first leg member having a top portion and a bottom portion, a second leg member having a top portion and a bottom portion, and a seat having a top surface, a bottom surface, and an attachment member for slidably attaching the top portion of one of the leg members and for pivotally attaching the other leg member below the top surface of the seat, thereby preventing the top portion of each of the leg members from separating from the seat. In a first resting position, the first and second leg members are substantially disposed adjacent the seat, and in a second resting position, the first and second leg members generally criss-cross each other and generally extend away from the seat. A backrest may be attached to the seat, preferably pivotally. In a first resting position, the backrest is substantially disposed adjacent the seat. In a second resting position, the backrest is substantially disposed away from the seat.

37 Claims, 15 Drawing Sheets

FOLDABLE SEATING DEVICE

This is a continuation of application Ser. No. 08/906,729, filed Aug. 5, 1997, which was abandoned on Aug. 4, 1999.

BACKGROUND OF THE INVENTION

The present invention relates generally to an apparatus for supporting a user, such as benches, seats, stools or chairs, and in particular, but not by way of limitation, to foldable seating devices, and even more particularly, but not by way of limitation, to foldable benches for use in bathtubs, showers, or the like.

Many varieties of chairs, benches, seats, stools, or the like have been previously proposed. However, a relative dearth of seating devices for use in a bathtub or shower still remains.

Many people would benefit from a seating aid during bathing or showering, including elderly, handicapped, infirmed, injured, incapacitated or handicapped persons. The seating apparatus may be useful because of a condition of the user or of the bathing facility.

One primary consideration for such a seating aid is adequate support of the user. The seat should possess a construction which is adequate to at least support the weight of the user, both while the user remains stationary upon the seat and while getting on or off the seat.

Another primary consideration for such a seating aid is the space available in the bathing facility for maneuvering, positioning, and/or storing the device. Typically, bathing facilities are constructed with a minimum of open space or storage space. For example, if a user inside a bathroom were to attempt to maneuver a typical chair into and out of a bathtub or shower, the user would likely be quite restricted in the range of motion available with the chair. During such maneuvers, the user would likely collide with another fixture in the bathroom, and would likely have difficulty getting the chair into the bathtub or shower stall. The frequent transporting of the chair into and out of the bathing area becomes a necessity when other users of the bathing area cannot, or do not wish to, utilize the assistance of the seating aid.

Furthermore, such a seating device should be relatively self-contained in order to reduce or prevent excessive protruding or extending of various portions of the device, thereby minimizing unintentional contact between the device and the user and/or the often cramped surroundings.

Moreover, such a device should be capable of manipulation by a single user without the aid of tools.

One object of the present invention is to provide a foldable seating device which is easy to use and maneuver.

Another object of the present invention is to provide a foldable seating device which supports a user in a bathing or showering environment.

Yet another object of the present invention is to provide a foldable seating device which is deployable by a single user without tools.

Still another object of the present invention is to provide a foldable seating device which is self-contained.

A still further object of the present invention is to provide a foldable seating device which is not unwieldy, and which is convenient to use in a cramped setting.

Another object of the present invention is to provide a foldable seating device which can lie substantially flat when folded.

Other objects of the present invention, as well as particular features, elements, and advantages thereof, will be elucidated in, or be apparent from, the following description and the accompanying drawing figures.

SUMMARY OF THE INVENTION

In one preferred embodiment, the present invention provides a foldable bench comprising a first leg means having a top portion and a bottom portion, a second leg means having a top portion and a bottom portion, and a seat having a top surface, a bottom surface, and attachment means for slidably attaching the top portion of the first leg means below the top surface of the seat and pivotally attaching the top portion of the second leg means below the top surface of the seat, thereby preventing the top portion of each of the leg means from separating from the seat. The seat allows the first and second leg means to move between a first resting position and a second resting position. In the first resting position, the first and second leg means are substantially disposed adjacent the seat, and in the second resting position, the first and second leg means generally criss-cross each other and generally extend away from the seat. The bench may include a means to prevent lateral movement of the second leg means with respect to the seat.

In another preferred embodiment, the present invention relates to a foldable bench comprising two pairs of legs, each leg having a top portion and a bottom portion, and a seat having a top surface, a bottom surface, and attachment means for slidably attaching the top portion of a first pair of legs below the top surface of the seat and pivotally attaching the top portion of a second pair of legs below the top surface of the seat, thereby preventing the top portion of each of the legs from separating from the seat. The seat allows the first and second pairs of legs to move between a first resting position and a second resting position, wherein, in the first resting position, the two pairs of legs are substantially disposed adjacent the seat, and in the second resting position, the two pairs of legs generally criss-cross each other and generally extend away from the seat.

In yet another preferred embodiment, the present invention concerns a foldable bench comprising a seat having a bottom surface and a stop means disposed on the bottom surface, a first pair of legs having an upper portion pivotally mounted to the bottom surface of the seat opposite the stop means, a second pair of legs pivotally attached to the first pair of legs intermediate respective upper and lower portions, wherein the first and second pairs of legs are adapted to move between a first resting position and a second resting position, and at least one race disposed on the bottom surface of the seat, the race being adapted to allow at least a part of the upper portion of the second pair of legs to slide therein. In the first resting position, the first and second pairs of legs are substantially disposed adjacent the seat. In the second resting position, the first and second pairs of legs generally criss-cross each other, the second pair of legs releasably engage the stop means, and the stop means substantially prevents the second pair of legs from moving in at least one direction. Thus, the bench assumes a folded state when the first and second pairs of legs are in the first resting position.

In still another preferred embodiment, the present invention relates to a foldable bench comprising a seat having a top surface, a bottom surface, and a stop means disposed on the bottom surface, a first pair of legs pivotally mounted to the bottom surface of the seat opposite the stop means, and a second pair of legs pivotally attached to the first pair of legs, wherein the first and second pairs of legs are adapted to move between a first resting position and a second resting position. In the first resting position, the first and second pairs of legs are substantially disposed adjacent the seat. In the second resting position, the first and second pairs of legs generally criss-cross each other, the second pair of legs releasably engage the stop means, and the stop means substantially prevents the second pair of legs from moving in at least one direction. Thus, the bench assumes a folded state when the first and second pairs of legs are in the first resting position. Preferably, the stop means substantially prevents the second pair of legs from moving toward the outer periphery of the seat. The seat further preferably comprises at least one race disposed on the bottom surface of the seat, the race being adapted to allow at least a portion of the second pair of legs to slide therein. The race may substantially prevent the second pair of legs from moving perpendicular to the seat. The stop means may include means for releasably locking the second pair of legs to the stop means. The releasable locking means may include at least one clamp, and/or the releasable locking means may include at least one indentation formed in the stop means.

The foldable bench may further comprise a backrest attached to the seat. Preferably, the backrest is pivotally attached to the seat. The backrest may be adapted to move between a first resting position and a second resting position. In the first resting position, the backrest is substantially disposed adjacent the seat. In the second resting position, the backrest is substantially disposed away from the seat. Thus, the bench may assume a fully folded state when the backrest and the first and second pairs of legs are in the first resting position.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which:

FIG. 1 is an isometric side view of a foldable bench having a backrest according to the present invention.

FIG. 2 is an isometric view of the underside of the foldable bench of FIG. 1 wherein the backrest is in a folded position.

FIG. 3 is an isometric close-up view of the rear of the foldable bench of FIG. 1 wherein the backrest is in an unfolded position.

FIG. 4 is an isometric view of the foldable bench of FIG. 1 in a fully closed position, showing the top surface of the seat.

FIG. 5 is another isometric view of the foldable bench of FIG. 1 in a fully closed position showing the bottom surface of the seat.

FIG. 12 is a front and top isometric view of a foldable bench according to the present invention.

FIG. 13 is a bottom plan view of the seat of the foldable bench of FIG. 12.

FIG. 14 is a bottom plan view of the foldable bench of FIG. 12 with the legs in a first, fully closed, resting position.

FIG. 15 is an isometric side view of the foldable bench of FIG. 14 in a first, fully closed, position.

FIG. 16 is an isometric bottom view of the foldable bench of FIG. 12 in a second, fully open, position.

FIG. 17 is an isometric bottom view of the foldable bench of FIG. 12 in a partially closed position.

DETAILED DESCRIPTION OF THE PREFERRED EMBODIMENTS

Figure 1:
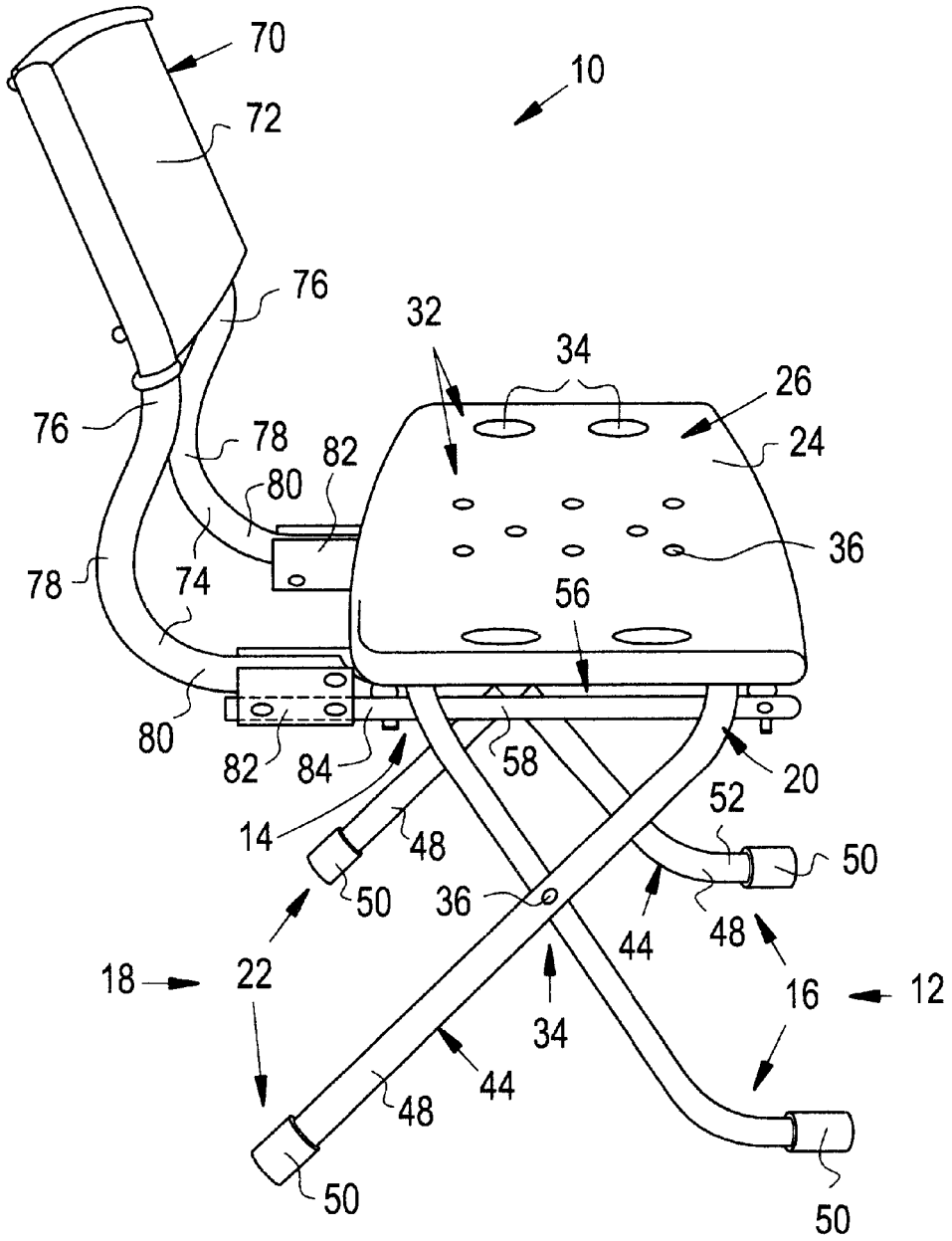
FIGS. 1–5 illustrate a first particular embodiment a foldable bench having a backrest according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

In one preferred embodiment, the present invention provides a foldable bench comprising a first leg means having a top portion and a bottom portion, a second leg means having a top portion and a bottom portion, and a seat having a top surface, a bottom surface, and attachment means for slidably attaching the top portion of the first leg means below the top surface of the seat and pivotally attaching the top portion of the second leg means below the top surface of the seat, thereby preventing the top portion of each of the leg means from separating from the seat. The bench may include means for preventing lateral movement of the second leg means with respect to the seat.

The seat allows the first and second leg means to move between a first resting position and a second resting position. In the first resting position, the first and second leg means are substantially disposed adjacent the seat, and in the second resting position, the first and second leg means generally criss-cross each other and generally extend away from the seat.

Preferably, the first and second leg means are pivotally attached to one another intermediate respective top and bottom portions.

The seat further comprises a stop means disposed below the top surface of the seat for limiting the sliding movement of one of the leg means. The stop means may be disposed between the top and bottom surfaces of the seat, or the stop means may be disposed at the bottom surface of the seat.

The attachment means may be disposed at the bottom surface of the seat, or the attachment means may be disposed between the top and bottom surfaces of the seat.

At least one of the leg means preferably comprises a substantially U-shaped leg member having a bight portion engaged by the attachment means.

The foldable bench may further comprise a backrest attached to the seat. Preferably, the backrest is pivotally attached to the seat. Thus, the backrest may be adapted to move between a first resting position and a second resting position. In the first resting position, the backrest is substantially disposed adjacent the seat, and in the second resting position, the backrest is substantially disposed away from the seat. The bench may thus assume a fully folded state when the backrest and the first and second pairs of legs are in the first resting position.

In another preferred embodiment, the present invention relates to a foldable bench comprising two pairs of legs, each leg having a top portion and a bottom portion, and a seat having a top surface, a bottom surface, and attachment means for slidably attaching the top portion of a first pair of legs below the top surface of the seat and pivotally attaching the top portion of a second pair of legs below the top surface of the seat, thereby preventing the top portion of each of the legs from separating from the seat. The seat allows the first and second pairs of legs to move between a first resting position and a second resting position, wherein, in the first resting position, the two pairs of legs are substantially disposed adjacent the seat, and in the second resting position, the two pairs of legs generally criss-cross each other and generally extend away from the seat.

In yet another preferred embodiment, the present invention concerns a foldable bench comprising a seat having a bottom surface and a stop means disposed on the bottom surface, a first pair of legs having an upper portion pivotally mounted to the bottom surface of the seat opposite the stop means, a second pair of legs pivotally attached to the first pair of legs intermediate respective upper and lower portions, wherein the first and second pairs of legs are adapted to move between a first resting position and a second resting position, and at least one race disposed on the bottom surface of the seat, the race being adapted to allow at least a part of the upper portion of the second pair of legs to slide therein. In the first resting position, the first and second pairs of legs are substantially disposed adjacent the seat. In the second resting position, the first and second pairs of legs generally criss-cross each other, the second pair of legs releasably engage the stop means, and the stop means substantially prevents the second pair of legs from moving in at least one direction. Thus, the bench assumes a folded state when the first and second pairs of legs are in the first resting position.

In still another preferred embodiment, the present invention relates to a foldable bench comprising a seat having a top surface, a bottom surface, and a stop means disposed on the bottom surface, a first pair of legs pivotally mounted to the bottom surface of the seat opposite the stop means, and a second pair of legs pivotally attached to the first pair of legs, wherein the first and second pairs of legs are adapted to move between a first resting position and a second resting position. In the first resting position, the first and second pairs of legs are substantially disposed adjacent the seat. In the second resting position, the first and second pairs of legs generally criss-cross each other, the second pair of legs releasably engage the stop means, and the stop means substantially prevents the second pair of legs from moving in at least one direction. Thus, the bench assumes a folded state when the first and second pairs of legs are in the first resting position.

Preferably, the stop means substantially prevents the second pair of legs from moving toward the outer periphery of the seat.

The seat further preferably comprises at least one race disposed on the bottom surface of the seat, the race being adapted to allow at least a portion of the second pair of legs to slide therein. The race may substantially prevent the second pair of legs from moving perpendicular to the seat.

The stop means may include means for releasably locking the second pair of legs to the stop means. The releasable locking means may include at least one clamp, and/or the releasable locking means may include at least one indentation formed in the stop means.

The first pair of legs may be attached to each other. In a particular embodiment, the first pair of legs is integrally attached. The first pair of legs may include a connecting portion which connects each of the first pair of legs. In a particular embodiment, the first pair of legs has a substantially U-shape.

Similarly, the second pair of legs may be attached to each other. In a particular embodiment, the second pair of legs is integrally attached. The second pair of legs may include a connecting portion which connects each of the second pair of legs. In a particular embodiment, the second pair of legs has a substantially U-shape.

The foldable bench may further comprise a backrest attached to the seat. Preferably, the backrest is pivotally attached to the seat. The backrest may be adapted to move between a first resting position and a second resting position. In the first resting position, the backrest is substantially disposed adjacent the seat. In the second resting position, the backrest is substantially disposed away from the seat. Thus, the bench may assume a fully folded state when the backrest and the first and second pairs of legs are in the first resting position.

FIGS. 1–5 illustrate a first particular embodiment of the present invention. A foldable bench 10 includes a first leg means 12 having a top portion 14 and a bottom portion 16, a second leg means 18 having a top portion 20 and a bottom portion 22.

A seat 24 has a top surface 26, a bottom surface 28, and attachment means 30 for slidably attaching the top portion 14 of the first leg means 12 below the top surface 26 of the seat 24 and pivotally attaching the top portion 20 of the second leg means 18 below the top surface 26 of the seat 24. Thus, the attachment means 30 prevents the top portion 14, 20 of each of the leg means 12, 18 from separating from the seat 24.

The seat 24 allows the first and second leg means 12, 18 to move between a first resting position and a second resting position.

Figure 4:
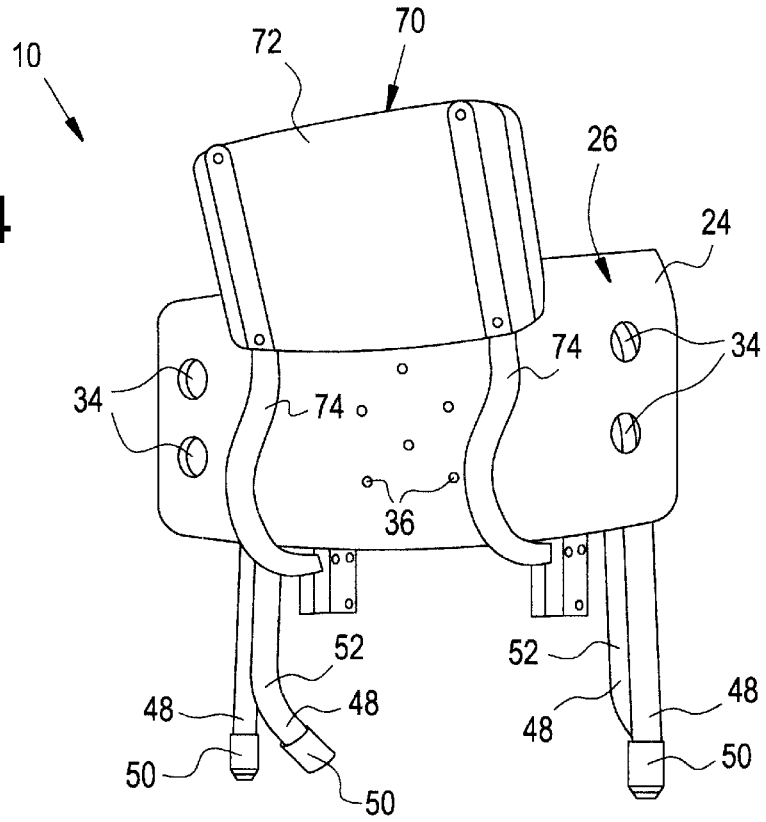
Figure 5:
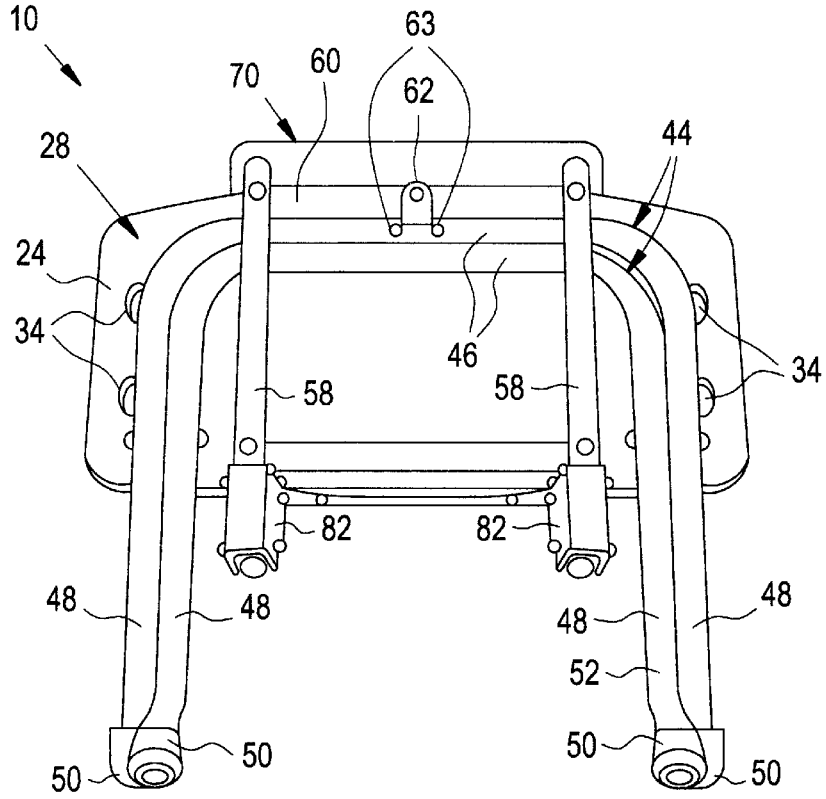

As illustrated in FIGS. 4–5, in the first resting position, the first and second leg means 12, 18 are substantially disposed adjacent the seat 24.

Figure 2:
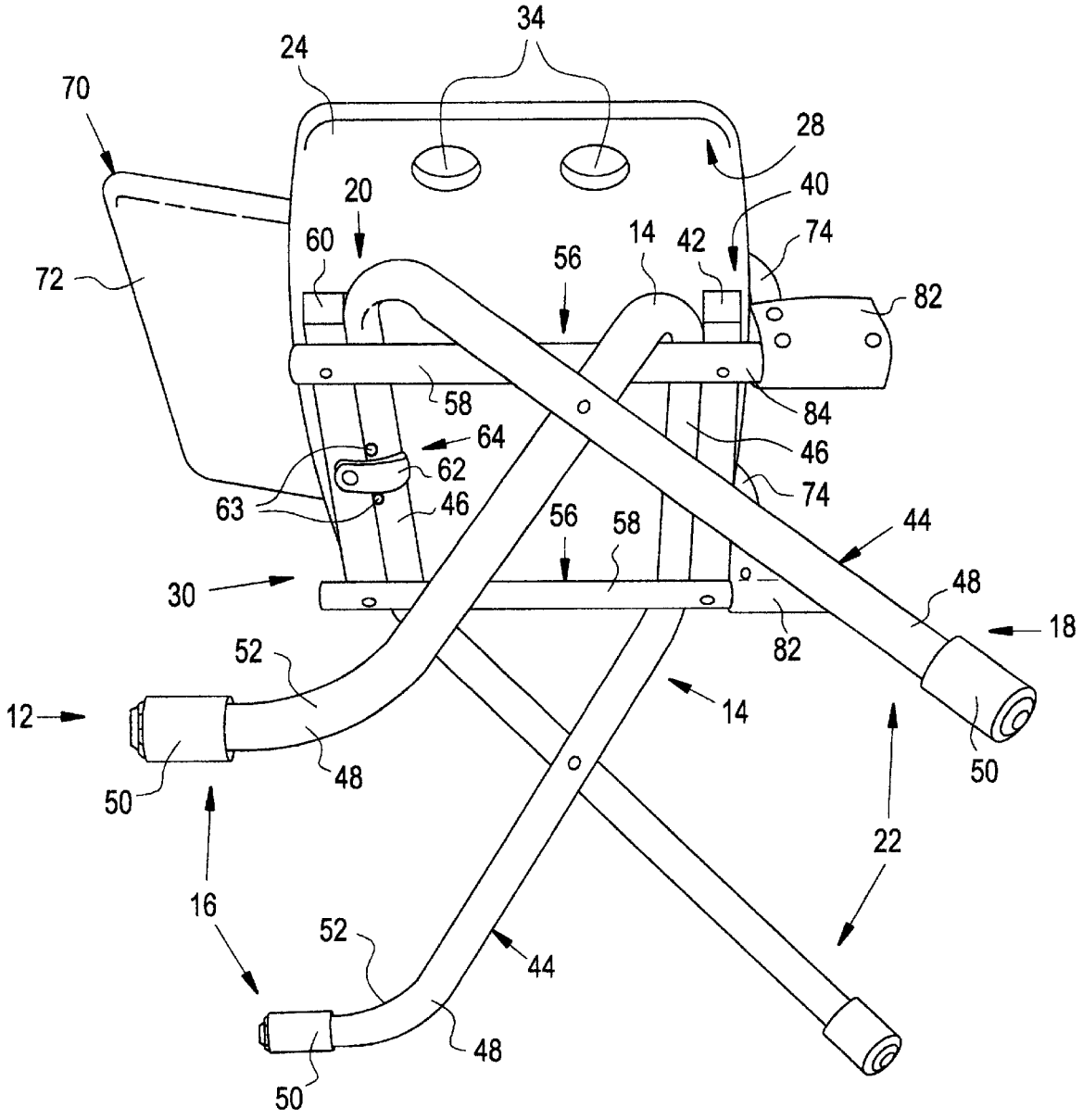
Figure 3:
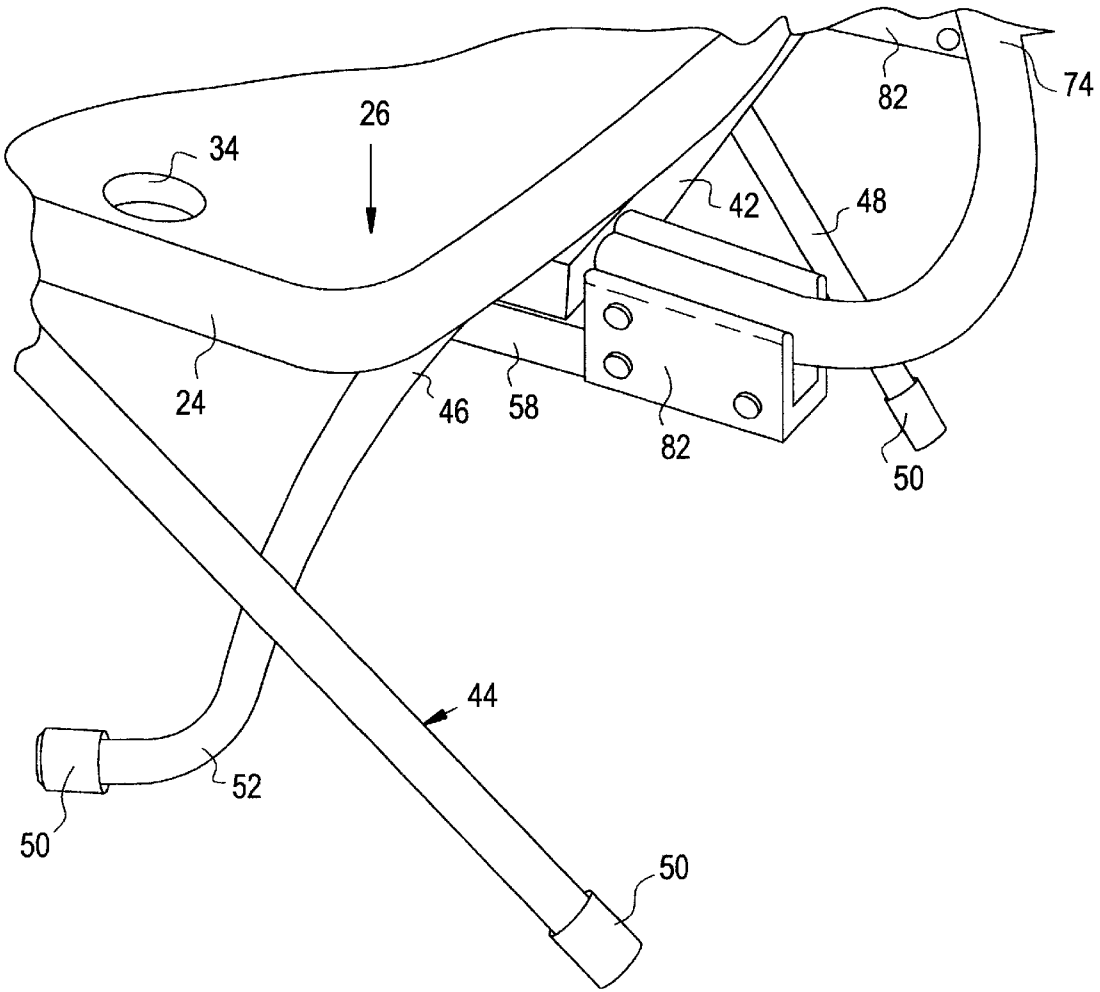

As seen in FIGS. 1–3, in the second resting position, the first and second leg means 12, 18 generally criss-cross each other and generally extend away from the seat 24.

The seat 24 may be provided with one or more througholes 32 for allowing liquids such as water to drain off the top surface 26 of the seat 24 and to pass therethrough. Such openings 32 are particularly preferred for bathing or showering applications. Large througholes 34 may be provided near the periphery of the seat 24, while smaller througholes 36 may be provided proximate the interior portion of the seat 24. The larger througholes 34 may be adapted to provide finger or thumb holds or hand holds for providing additional support to the user. Similarly, slots may also be provided.

Preferably the seat 24 is made from a lightweight material which is strong enough to support the weight of the intended user. Water resistant material is preferably used, particularly for bathing or showering applications. Aluminum, wood, or various plastics, such as polyethylene, may be suitably utilized. Plastic material may be injection molded into the desired shape of the seat 24. Aluminum may be stamped into a desired shape. The seat 24 may also be fabricated from a combination of materials, such as aluminum and plastic. The seat 24, as well as all exposed parts of the bench 10, is preferably formed or finished to avoid sharp points or edges.

The first and second leg means 12, 18 are pivotally attached to one another intermediate respective top 14, 20 and bottom 16, 22 portions at pivot points 34. A pivot connection means 36 such as a rivet, rod, bolt, or some other type of connector may be used to connect the first and second leg means 12, 18.

As best seen in FIG. 2, the seat 24 further comprises a stop means 40 disposed below the top surface 26 of the seat 24 for limiting the sliding movement of the first leg means 12. The stop means 40 may be disposed between the top and bottom surfaces 26, 28 of the seat 24, as discussed below, or the stop means 40 may be disposed substantially at the bottom surface 28 of the seat 24, as represented by FIGS. 1–5. The stop means 40 may be a cross-piece 42 which is attached to the remainder of the seat 24, for example by screws, bolts, or rivets, or the stop means 24 may be integrally formed with the remainder of the seat 24.

In FIGS. 1–5, the attachment means 30 is disposed at the bottom surface 28 of the seat 24. In other embodiments, such as those discussed below, the attachment means 30 may be disposed between the top 26 and bottom 28 surfaces of the seat 24.

Preferably, at least one of the leg means, i.e. the first leg means 12 or the second leg means 18, comprises a substantially U-shaped leg member 44 having a bight portion 46, which is engaged by the attachment means 30, and which connects two legs 48. In a particularly preferred configuration, as best seen in FIGS. 2 and 5, the first leg means 12 and the second leg means 18 each comprise a substantially U-shaped leg member 44 having a bight portion 46 and two legs 48. The free distal ends of each of the legs 48 may preferably be provided with an anti-skid cap 50 made from rubber or a rubber-like plastic or some other material which retards slipping between the distal ends of the legs 48 and the supporting surface upon which the bench 10 is placed.

In a particularly preferred configuration, the distal ends of the first leg means 12 has a bent portion 52 which is generally angled or curved toward the seat 24. Such a configuration assists providing support and in preventing slippage between the bench 10 and a supporting surface.

As best seen in FIG. 2, the attachment means 30 comprises first and second races 56 disposed on the bottom surface 28 of the seat 24. Each race 56 is formed from a longitudinal rod 58 attached to and spaced apart from the bottom surface 28 of the seat 24 so that each race 56 is adapted to allow at least a part of the upper portion of the second pair of legs 18 to slide therein. The longitudinal rods 58 are shown mounted on the stop cross-piece 42 which forms the stop means 40 and a second cross-piece 60 disposed opposite the stop cross-piece 42. The construction of the second cross-piece 60 may be similar to the stop cross-piece 42, wherein the second cross-piece 60 may be attached to the bottom surface 28 of the seat 24 or may be integrally formed with the remainder of the seat, as discussed above. A clamp or clip 62 may be attached to the second cross-piece 60 and over the top portion of the second leg means 18, such as the bight portion 46 of the U-shaped second leg member 18 which has a pair of projections 63 which straddle the clamp 62 and prevent lateral movement of the second leg means 18 with respect to the seat 24. The second leg means 18 may then pivot therein but otherwise be substantially prevented from moving in any other direction, thereby providing a pivotal connection means 64. Thus, the top portions of each leg means 12, 18 are contained by the attachment means 30 whether in the first resting position, the second resting position, or anywhere therebetween. Alternately, or in addition, the clamp or clip 62 or pivotal connection means 64 may be attached to the bottom surface 28 of the remainder of the seat 24. Thus, the second leg means 18 may pivot away from the seat 24 from a resting position.

The foldable bench 10 may further comprise a backrest 70 attached to the seat 24. Preferably, the backrest 70 is pivotally attached to the seat 24.

The backrest 70 may be adapted to move between a first resting position, as seen in FIGS. 2, 4, and 5, and a second resting position, as depicted in FIGS. 1 and 3. In the first resting position, the backrest 70 is substantially disposed adjacent the seat 24, and in the second resting position, the backrest 70 is substantially disposed away from the seat. As best seen in FIGS. 4–5, the bench 10 may thus assume a fully folded state when the backrest 70 and the first and second pairs of legs 12, 18 are in the first resting position.

The backrest 70 shown in FIGS. 1–5 comprises a horizontal member 72 and a pair of support members 74. The horizontal member 72 may be provided with one or more holes which are adapted to receive the top portion of the support members in order to provide a secure connection between the horizontal member and the support members.

The horizontal member 72 may be made from the same material as the seat. Preferably, the horizontal member 72 is made from a rigid material such as hard plastic or aluminum or wood. Alternately, the horizontal member may be made from a material which differs from the seat material. For example, the seat 24 may be made from a hard plastic while the horizontal member 72 may be made from a fabric, such as woven plastic or canvas. However, less rigid materials may require an additional horizontal support between the support members 74 to allow ease of actuation of the bench 10 between resting states.

As best seen in FIG. 1, each support member 74 may include a top portion 76, a curved portion 78, and a bottom portion 80. The curved portion 78 may generally place the top 76 and bottom 80 portions approximately 90 degrees apart. Furthermore, the curved portion 78 extends generally backward from the top portion 76. The bottom portion 80 of each support member 74 is pivotally attached to a respective bracket 82 which is attached to a protruding portion 84 of a respective longitudinal rod 58.

As best seen in FIG. 3, when the backrest 70 is in the second resting position, the bottom portion 80 of the support members 74 abuts a horizontal surface of the bracket 82, wherein backward movement of the backrest 70 with respect to the seat 24 is arrested.

Figure 6:
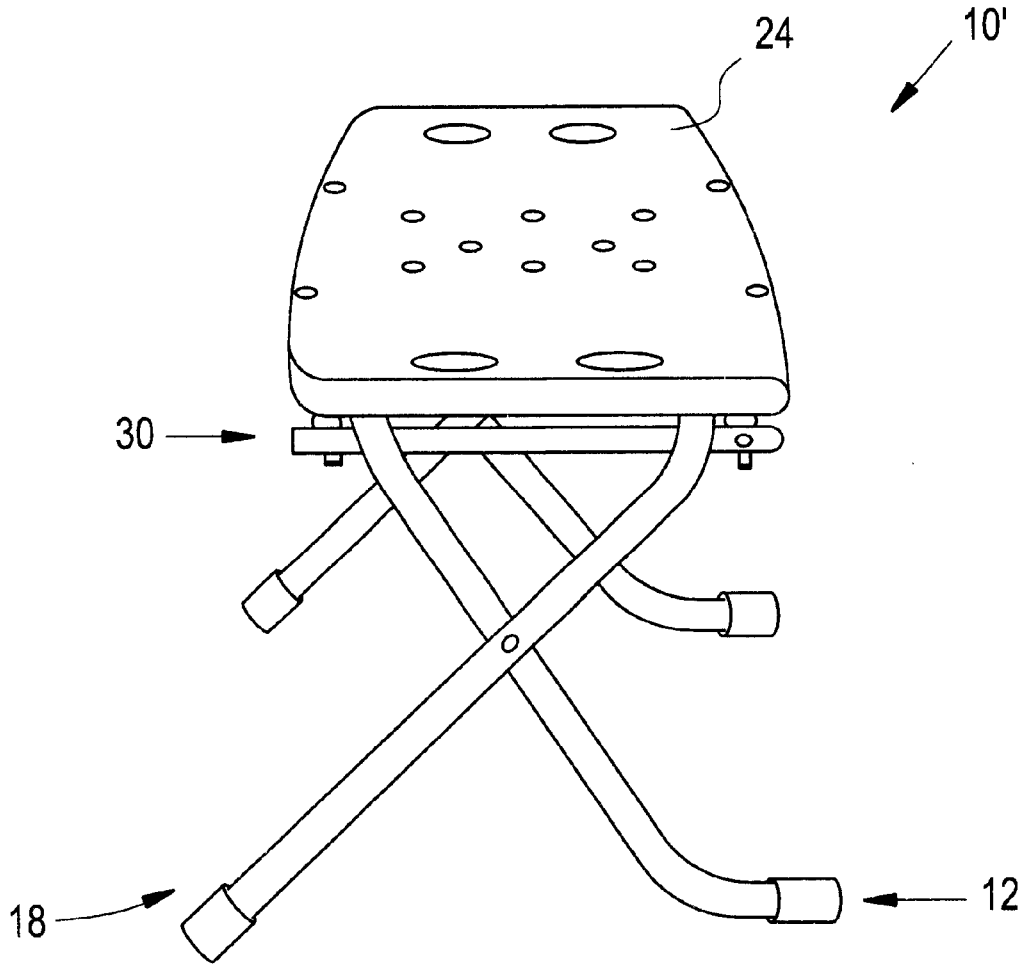
FIG. 6 is an isometric side view of a foldable bench, sans backrest, according to the present invention.

FIG. 6 shows another preferred embodiment of a foldable bench 10' of the present invention which is similar to the embodiment shown in FIGS. 1–5 but which does not possess a backrest. Accordingly, if no backrest is to be provided, brackets or protruding portions of the longitudinal rods need not be included. Of course, if a backrest may be optionally provided, such elements may be included, wherein the backrest may be adapted to be removably attached.

Figure 7:
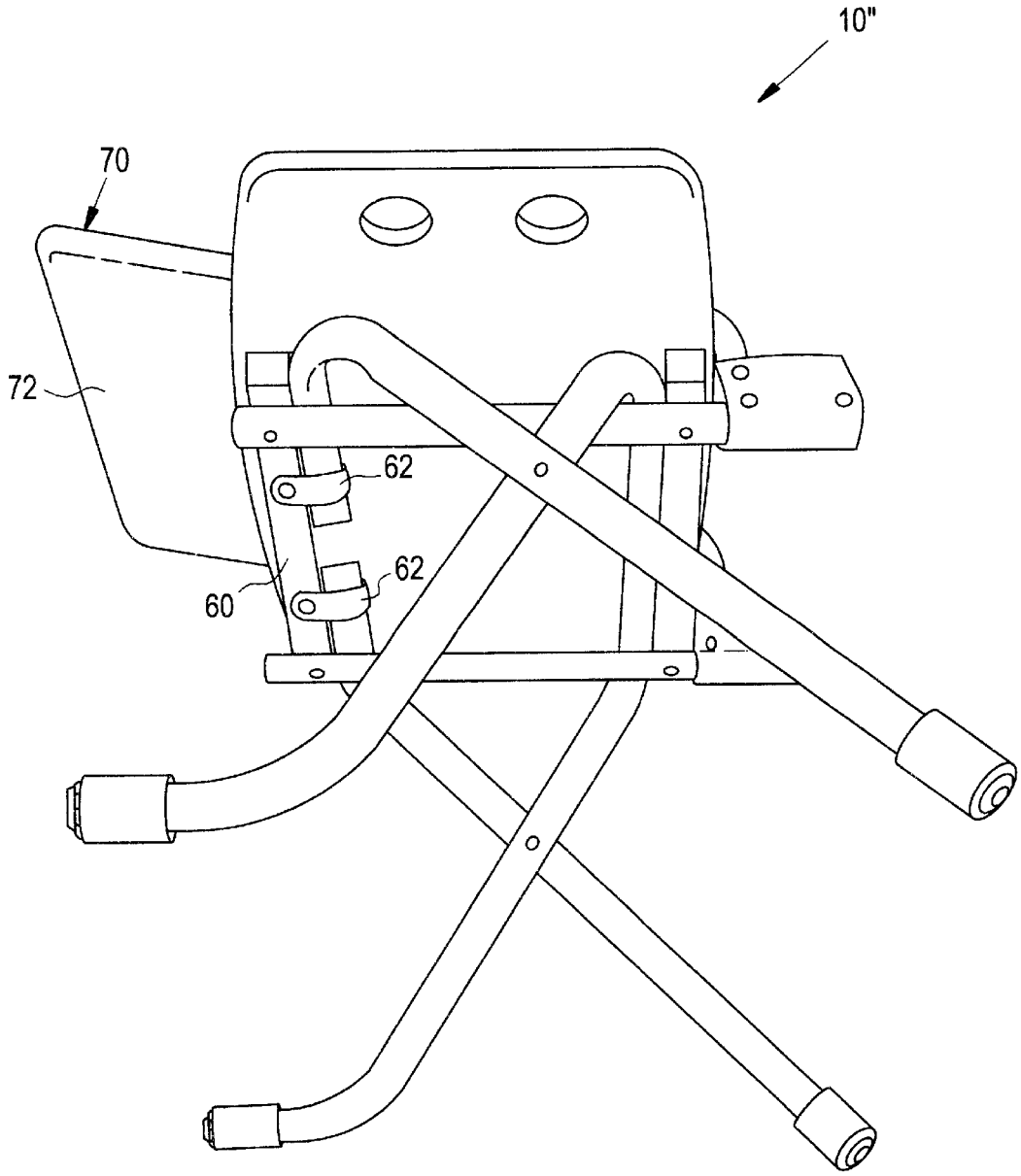
FIG. 7 is an isometric view of the underside of a foldable bench according to a particular embodiment of the present invention wherein the first leg means comprises two separate legs.

FIG. 7 shows an alternate embodiment of a foldable bench 10" of the present invention wherein the first leg means 12 comprises a U-shaped leg member 44, while the second leg means 18 comprises two separate legs 48. Each leg 48 is pivotally attached by a respective clamp or clip 62.

Figure 8:
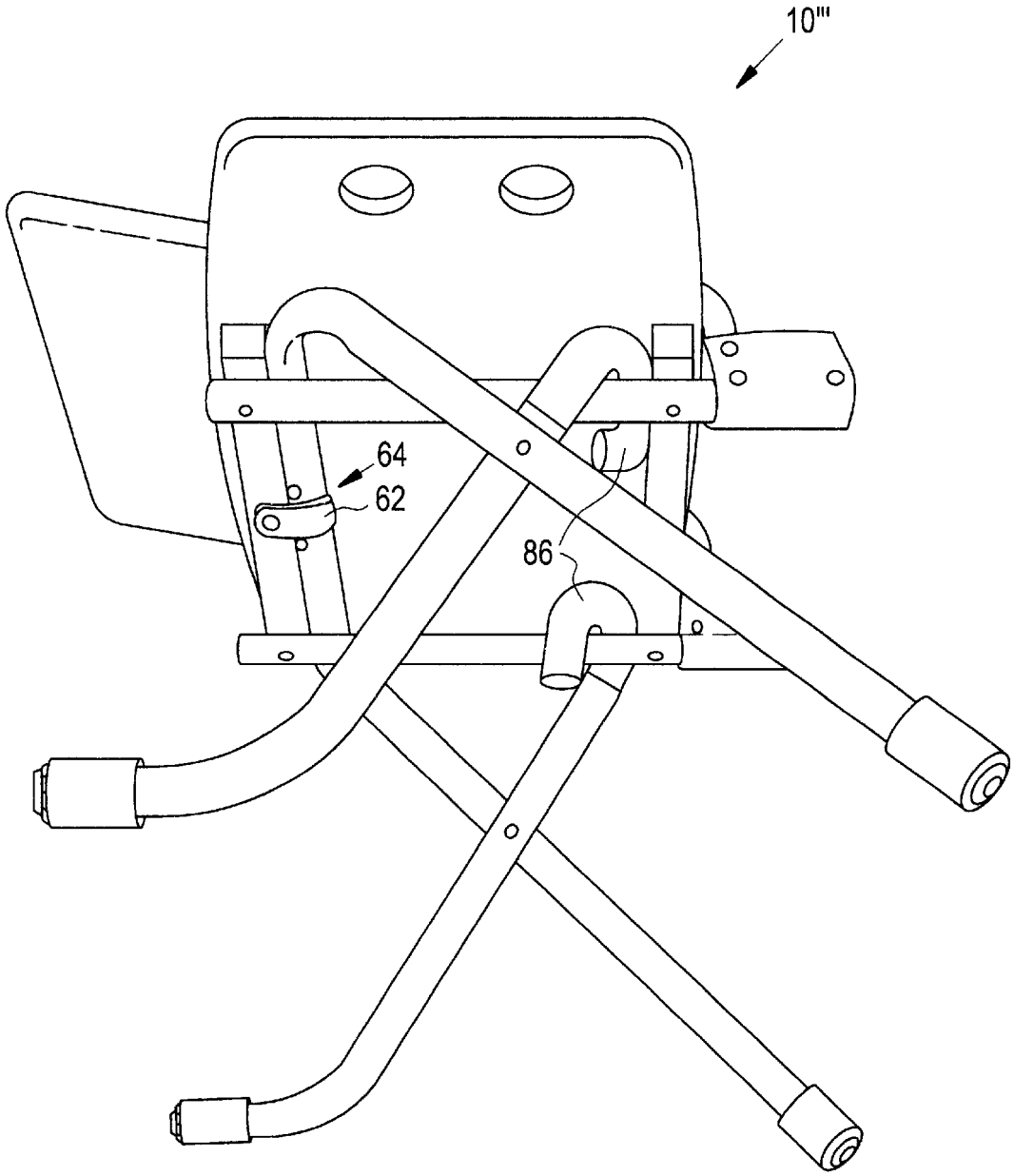
FIG. 8 is an isometric view of the underside of a foldable bench according to another particular embodiment of the present invention wherein the second leg means comprises two separate legs.

FIG. 8 shows yet another alternate embodiment of a foldable bench 10'" of the present invention wherein the second leg means 18 comprises a U-shaped leg member 44, while the first leg means 12 comprises two separate legs 48. The top portion of each leg 48 comprises a loop portion 86 which slidably engages respective longitudinal rods 58. The loop portion 86 may be a reduced friction element, such as made from a plastic material, which can slide over the rods 58. If the legs 48 are hollow tubes, a loop member such as an eyelet may be inserted into a leg 48 and attached thereto.

Figure 9:
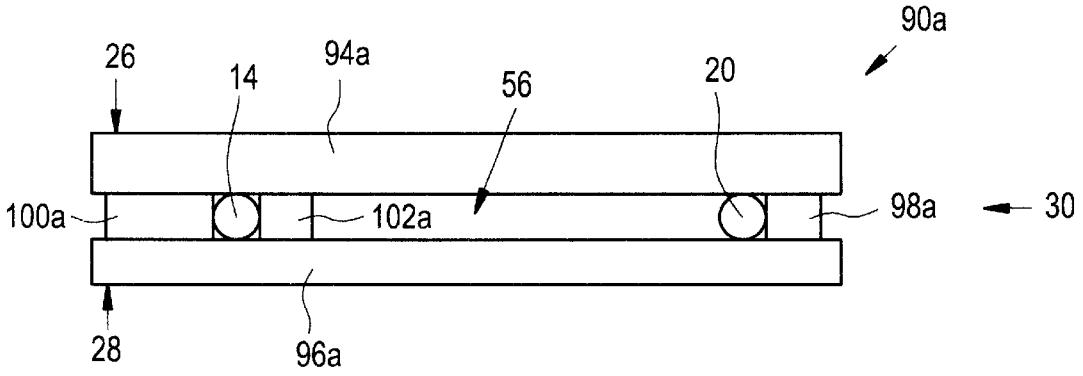
FIG. 9 illustrates another embodiment of a seat according to the present invention wherein the attachment means is disposed between the top and bottom surfaces of the seat.

FIG. 9 illustrates another embodiment of a seat 90*a* according to the present invention wherein the attachment means 30 is disposed between the top and bottom surfaces 26, 28 of the seat 90*a*. The seat 90*a* comprises a top portion 94*a*, a bottom portion 96*a*, a stop portion 98*a*, and first and second pivot portions 100*a*, 102*a*. The top and bottom portions 94*a*, 96*a* sandwich the stop portion 98*a* and the first and second pivot portions 100*a*, 102*a*. The top portion 14 of the first leg means 12 is pivotally disposed between the top portion 94*a*, bottom portion 96*a*, and first and second portions 100*a*, 102*a*. The top portion 20 of the second leg means 18 abuts the stop portion 98*a* in the second resting position or state. The bottom portion 96*a* may be a single, for example generally planar, member which extends longitudinally over at least part of the first and second pivot portions 100*a*, 102*a* and the stop portion 98*a*, or the bottom portion 96*a* may comprise a plurality of longitudinal members similarly disposed. Furthermore, some or all of the top portion 94*a*, bottom portion 96*a*, stop portion 98*a*, and first and second pivot portions 100*a*, 102*a* may be integrally formed with the remainder of the seat 90*a*, or one or more portions may be attached to other portions, e.g. by bolts, rivets, adhesives, etc.

Figure 10:
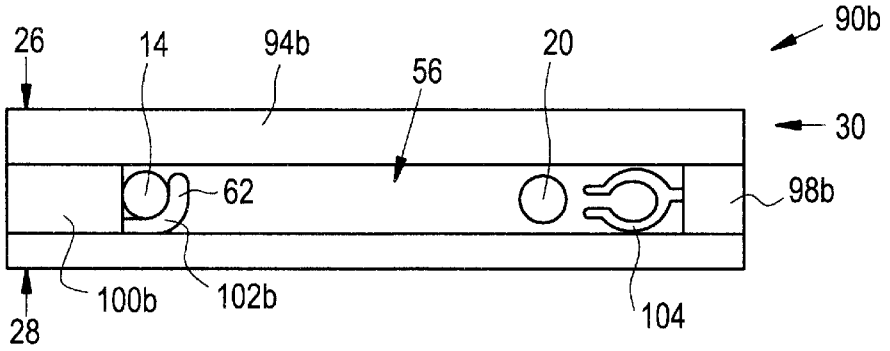
FIG. 10 illustrates another embodiment of a seat according to the present invention wherein the attachment means is disposed between the top and bottom surfaces of the seat and the stop means includes a clamp for releasably engaging the top portion of the second leg means.

FIG. 10 illustrates another embodiment of a seat 90*b* according to the present invention wherein the attachment means 30 is disposed between the top and bottom surfaces 26, 28 of the seat 90*b*. The seat 90*b* comprises a top portion 94*b*, a bottom portion 96*b*, a stop portion 98*b*, and first and second pivot portions 100*b*, 102*b*. The stop portion 98*b* includes a clamp 104 for releasably engaging the top portion 20 of the second leg means 18 when in the second resting position. Thus, the clamp 104 releasably locks the second leg means 18 in position. Preferably, the clamp 104 is constructed of sufficient size and strength so that a user may engage and disengage the clamp 104 using only manual power, i.e. without the assistance of tools or another person. The second pivot portion 102*b* may comprise a clip or clamp 62 for pivotally mounting the top portion 14 of the first leg means 12. Some or all of the top portion 94*b*, bottom portion 96*b*, stop portion 98*b*, and first and second pivot portions 100*b*, 102*b* may be integrally formed with the remainder of the seat 90*b*, or one or more portions may be attached to other portions.

Figure 11:
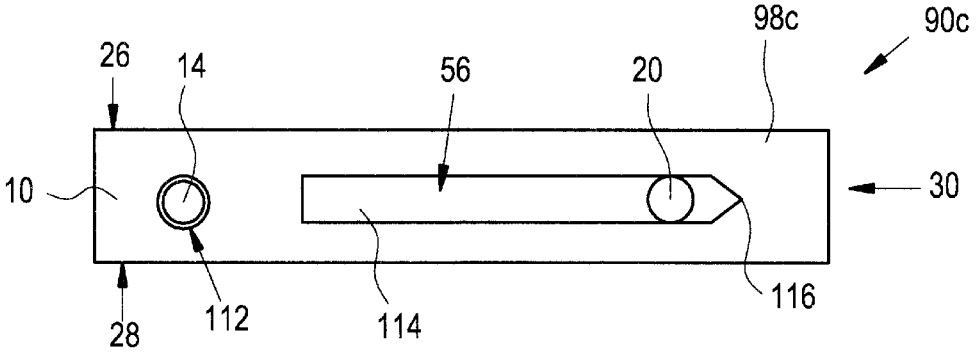
FIG. 11 illustrates yet another embodiment of a seat according to the present invention wherein the attachment means is disposed between the top and bottom surfaces of an integral seat body.

FIG. 11 illustrates yet another embodiment of a seat 90*c* according to the present invention wherein the attachment means 30 is disposed between the top and bottom surfaces 26, 28 of the seat 90*c*. The seat 90*c* comprises a single integral body 110 provided with a transversely disposed borehole 112, adapted to pivotally accept the top portion 14 of the first leg means 12, and a generally planar cavity 114 having open transverse ends and extending longitudinally and which serves as a race 56, wherein the cavity 114 is adapted to slidingly receive the top portion 20 of the second leg means 18 between the first and second resting positions. The seat 90*c* may optionally be provided with at least one indentation 116 formed in the stop portion 98*c* for releasably locking the top portion 20 of the second leg means 18 in the second resting position. Such locking and unlocking should be achievable by the intended user without further assistance.

Preferably, one or more of the first and second leg means 12, 18, support members 74 for the backrest 70, and longitudinal rods 58 is made from a lightweight, but strong, construction. It is particularly preferable to fabricate such members from tubular aluminum or steel stock. Alternately, such members could be made from other materials such as plastic, wood, or other metals, which may or may not utilize tubular construction, depending upon a particular application.

FIGS. 12–17 illustrate a particularly preferred embodiment of the present invention. A foldable bench 210 is shown which includes a first leg means 212 having a top portion 214 and a bottom portion 216, a second leg means 218 having a top portion 220 and a bottom portion 222.

Figure 13:
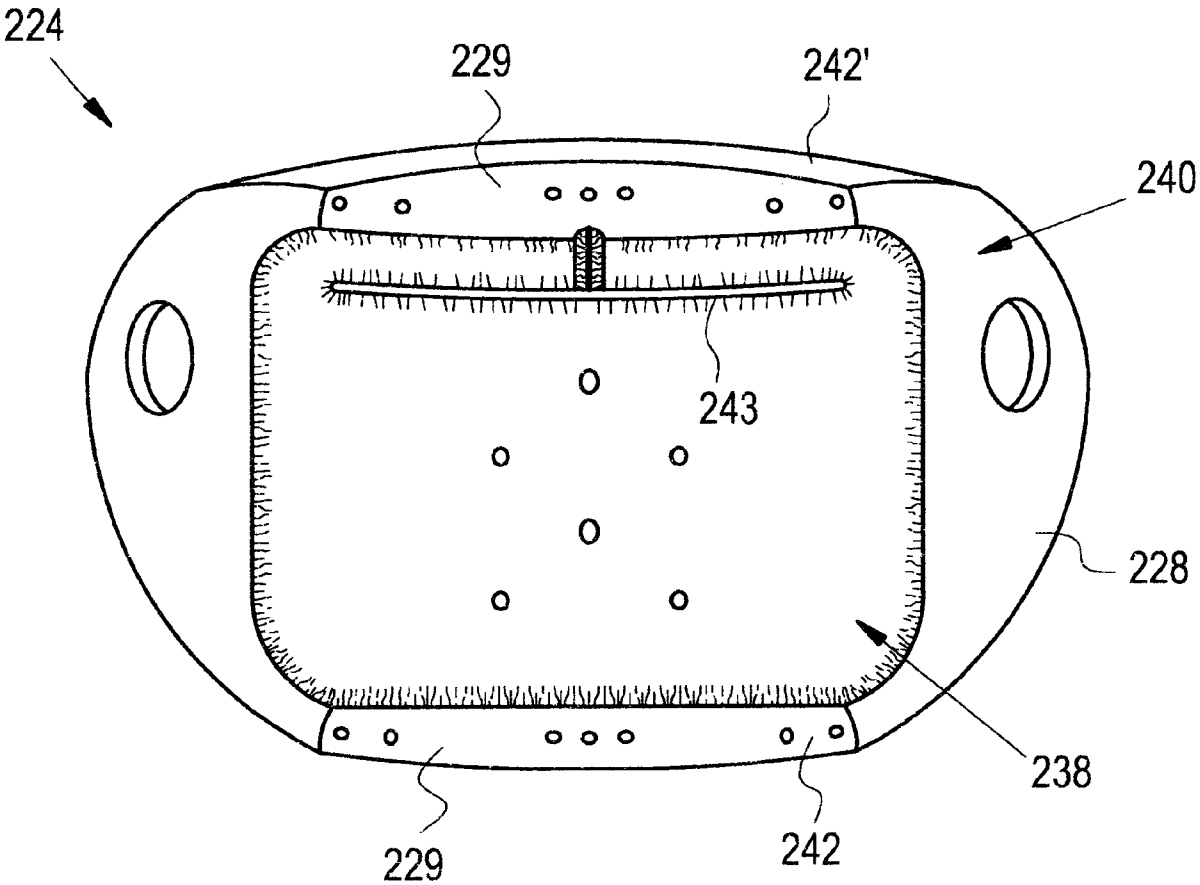
Figure 14:
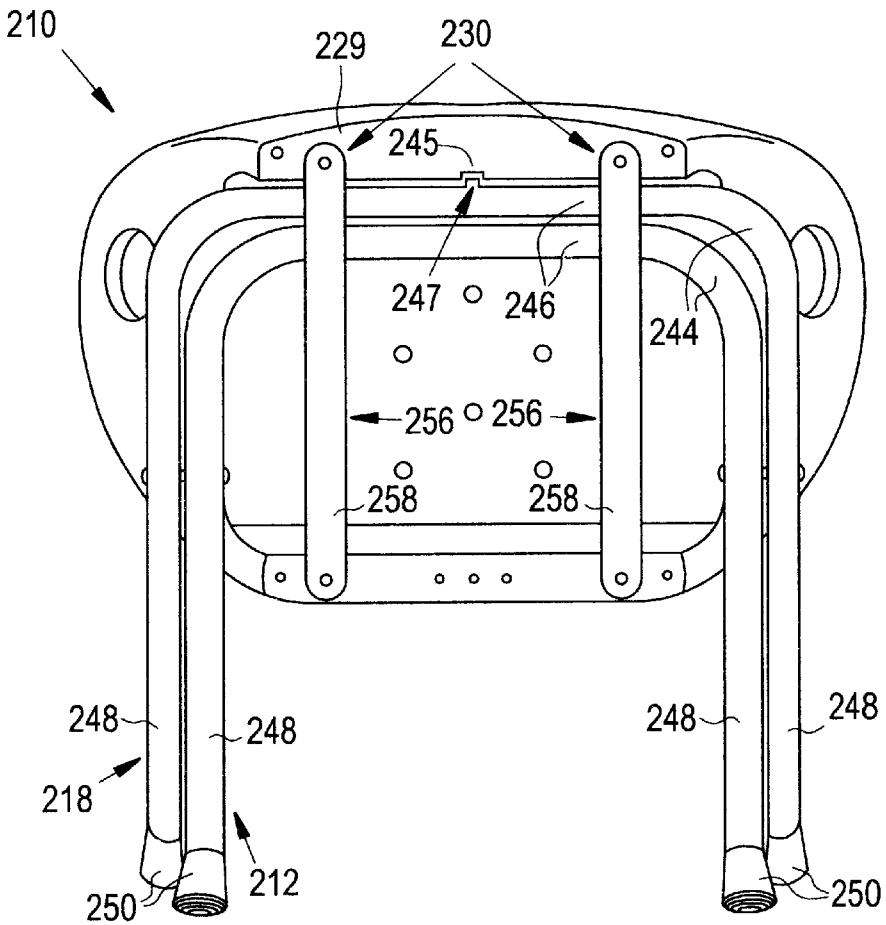

A seat 224 has a top surface 226, a bottom surface 228 as seen in FIG. 13, and attachment means 230 as seen in FIG. 14 for slidably attaching the top portion 214 of the first leg means 212 below the top surface 226 of the seat 224 and pivotally attaching the top portion 220 of the second leg means 218 below the top surface 226 of the seat 224. Thus, the attachment means 230 prevents the top portion 214, 220 of each of the leg means 212, 218 from separating from the seat 224.

The seat 224 allows the first and second leg means 212, 218 to move between a first resting position and a second resting position.

Figure 15:
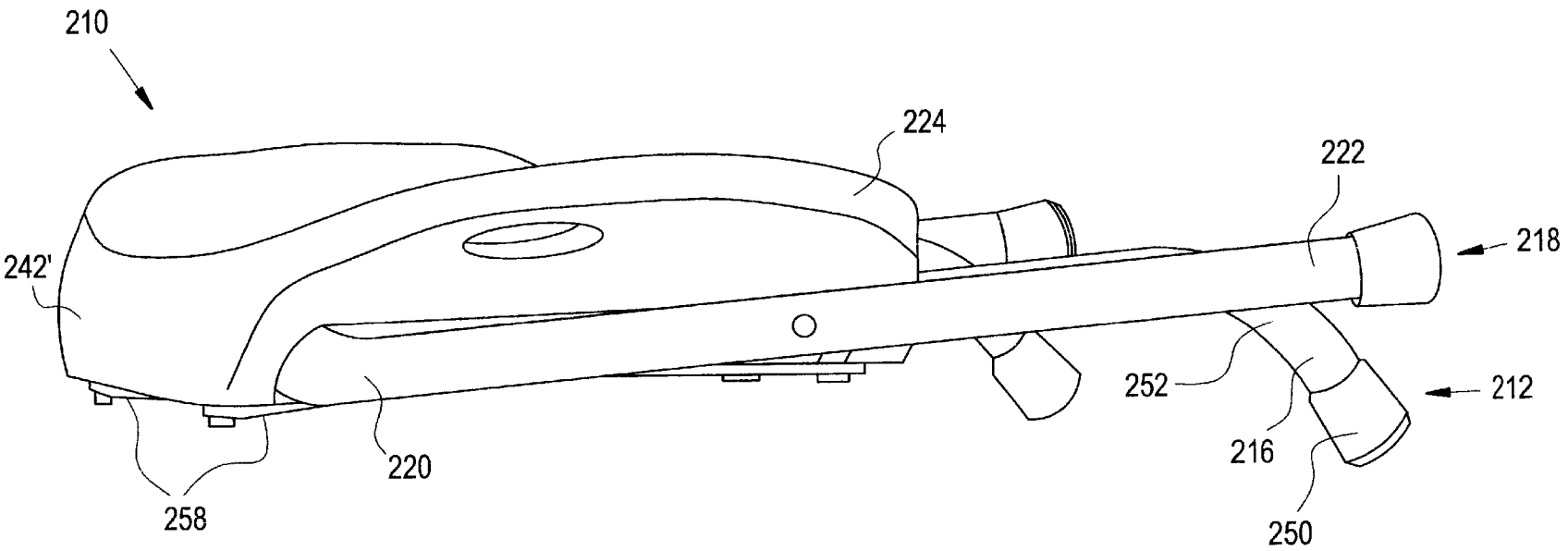

As illustrated in FIGS. 14 and 15, in the first resting position, the first and second leg means 212, 218 are substantially disposed adjacent the seat 224.

Figure 12:
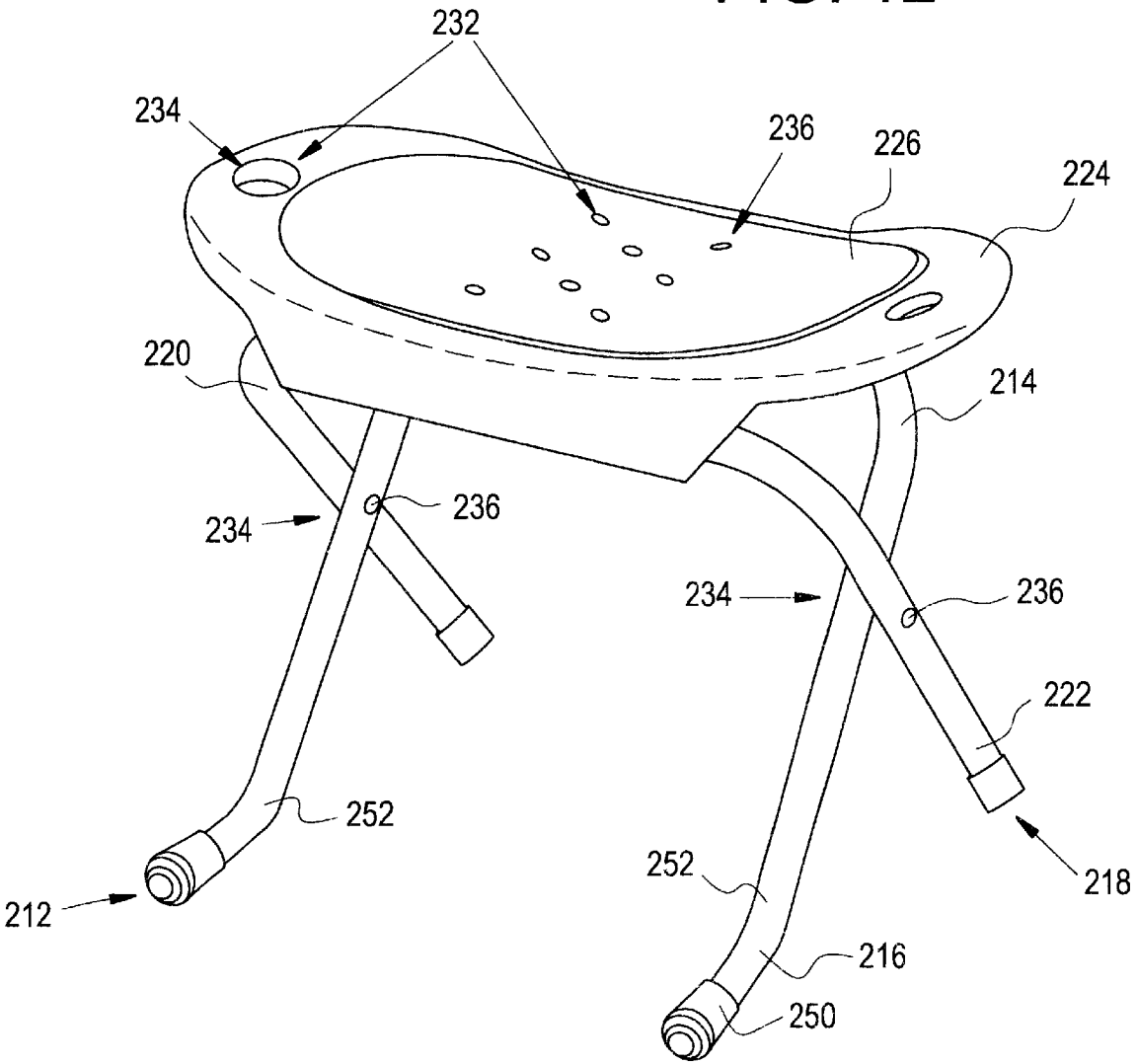
FIGS. 12–17 illustrate a particularly preferred embodiment of the present invention.
Figure 16:
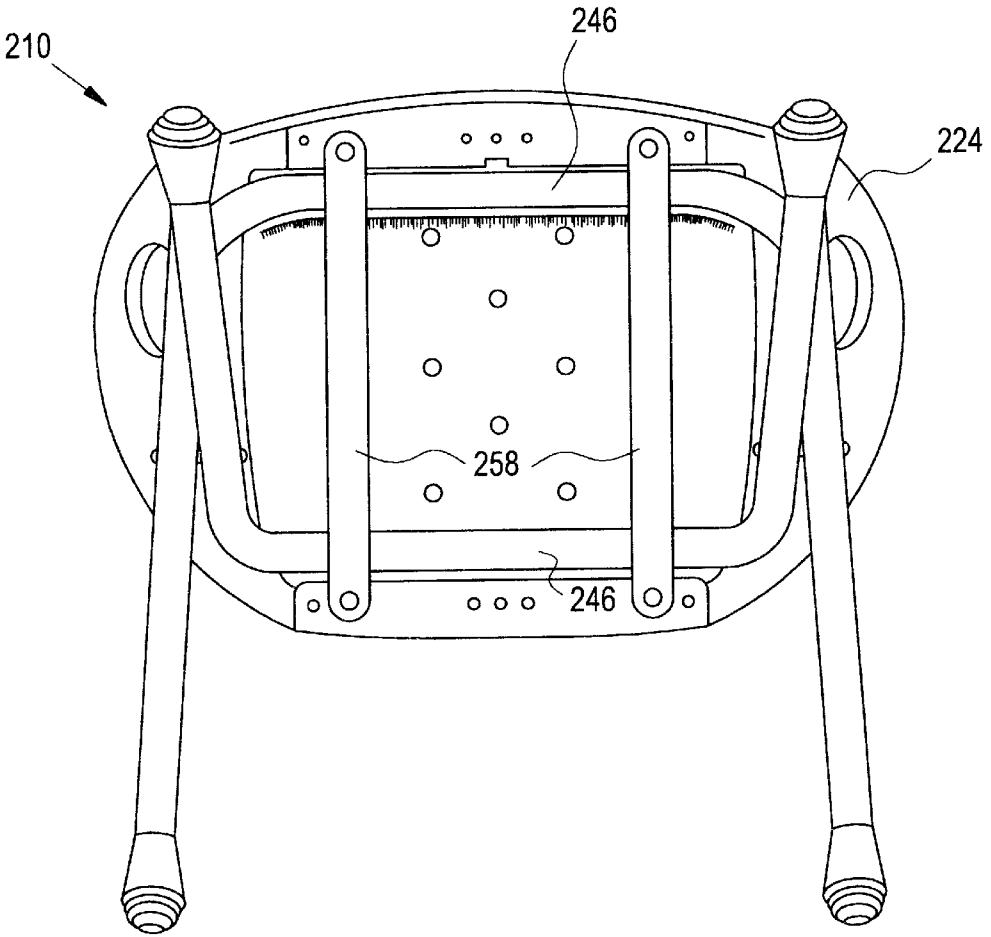

As seen in FIGS. 12 and 16, in the second resting position, the first and second leg means 212, 218 generally criss-cross each other and generally extend away from the seat 224.

Figure 17:
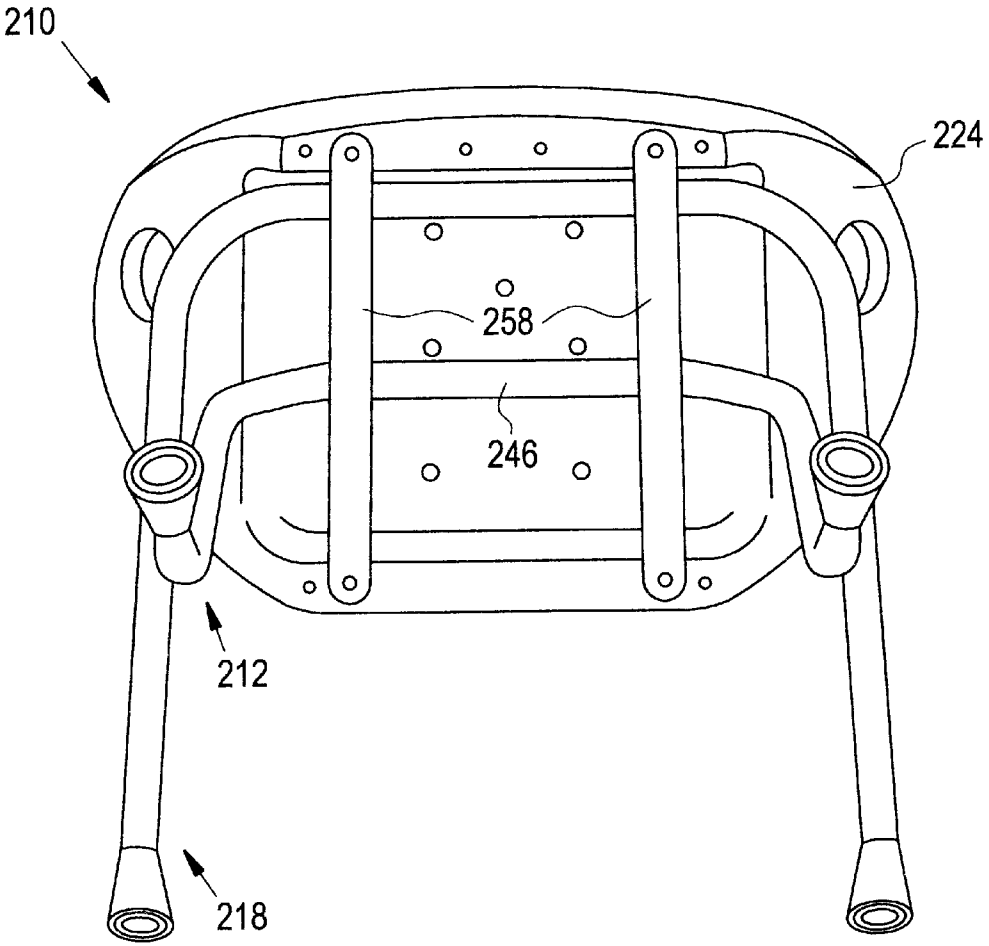

FIG. 17 shows the top portion 214 of the first leg means 212 disposed approximately midway between the first and second positions, wherein the top portion 214 is confined by the attachment means 230 and slides therein adjacent the seat 224.

The seat 224 is provided with througholes 232 for allowing liquids to drain off the top surface 226 of the seat 224 and to pass therethrough. Such openings 232 are particularly preferred for bathing or showering applications. Large throughholes 234 may be provided near the periphery of the seat 224, while smaller throughholes 236 may be provided proximate the interior portion of the seat 224.

Preferably the seat 224 is made from a lightweight, water resistant material which is strong enough to support the weight of the intended user. Preferably plastic material is injection molded into the desired shape of the seat 224. The seat 224, as well as all exposed parts of the bench 210, are preferably formed or finished to avoid sharp points or edges.

The bottom surface 228 of the seat 224 is provided with a recess 238 adapted to accommodate the top portions 214, 220 of the first and second leg means 212, 218.

The first and second leg means 212, 218 are pivotally attached to one another intermediate respective top 214, 220 and bottom 216, 222 portions at pivot points 234. A pivot connection means 236 such as a rivet, rod, bolt, or some other type of connector may be used to connect the first and second leg means 212, 218.

As best seen in FIGS. 13, 14, 16 and 17, the seat 224 further comprises a stop means 240 disposed below the top surface 226 of the seat 224 for limiting the sliding movement of the first leg means 212. The stop means 240 is integrally formed from the bottom surface 228 of the seat 224. The stop means 240 comprises a first transverse downwardly extending projection 242 preferably formed integrally with main body of the seat 224.

In a similar fashion, a second transverse downwardly extending projection 242' forms part of the bottom surface 228 of the seat 224 opposite the first transverse downwardly extending projection 242. Thus, the two downwardly extending projections 242, 242' define the longitudinal edges of the recess 238. The portions 229 of the bottom surface 228 formed by the downwardly extending projections 242, 242' are preferably substantially flat, and are preferably coplanar. A transverse ridge 243 is longitudinally spaced apart from the first downwardly extending projection 242 by a distance which allows the top portion 220 of the second leg means 218 to be pivotally disposed between the second transverse downwardly extending projection 242' and the transverse ridge 243. As shown in FIG. 13, preferably, the transverse ridge 243 extends substantially transversely across the recess 238. The height of the ridge should be sufficient to prevent the top portion 220 of the second leg means 218 from translating further into the recess 238. Both the downwardly extending projections 242, 242' and the transverse ridge 243 are preferably integrally formed with the remainder of the seat 224.

Thus, the attachment means 230 is disposed at the bottom surface 228 of the seat 224. In particular, the attachment means 230 is attached to the flat portions 229 of the bottom surface 228.

As best seen in FIG. 14, both the first leg means 212 and the second leg means 218 comprise a substantially U-shaped leg member 244 having a bight portion 246, which is engaged by the attachment means 230, and which connects two legs 248. The free distal ends of each of the legs 248 are preferably provided with an anti-skid cap 250 made from rubber or a rubber-like plastic or some other material which retards slipping between the distal ends of the legs 248 and the supporting surface upon which the bench 210 is placed.

As seen in FIG. 13, the bottom surface 228 of the seat 224 is provided with a longitudinal recess 245 which extends into the portion 229 adjacent the transverse ridge 243 and into the seat 224 deeper than the recess 238. As seen in FIG. 14, the bight portion 246 of the second leg means 218 includes a projection 247 which passes through the longitudinal recess 245 along an arc when said second leg means 218 is pivoted.

The portions of the seat 224 which form the sides of the longitudinal recess 245 are adapted to allow the projection 247 to move therewithin but importantly substantially prevent transverse or lateral movement of the projection 247 and hence the second leg means 218, thereby preventing misalignment of the first and second leg means 212, 218 which might lead to premature wear or difficulty folding and unfolding the bench. In particular, the prevention of lateral movement of the second leg means 218 also reduces wear on the pivot means 236, thus maintaining the moving parts of the bench in proper alignment for optimal operation and long life. The projection 247 may take the form of a rivet or screw head attached to the bight portion 246, or may be formed integrally therewith. A clamp, such as clamp 62 as shown in FIG. 2, may optionally be used instead, or in addition if more support is desired. Mating projections may also be used with such clamp.

The distal ends of the first leg means 212 has a bent portion 252 which is generally angled or curved toward the seat 224. Such a configuration provides additional stability and assists in preventing slippage between the bench 10 and a supporting surface.

As best seen in FIG. 14, the attachment means 230 comprises first and second races 256 disposed on the bottom surface 228 of the seat 224. Each race 256 is formed from a longitudinal plate 258 attached to and spaced apart from the bottom surface 228 of the seat 224 so that each race 256 is adapted to allow the bight portion 246 of the second leg means 218 to slide therein. The longitudinal plates 258 are shown mounted on the surface portions 229 of the first and second transverse downwardly extending projections 242, 242'. As seen in FIG. 14, the second U-shaped leg means 218 is wider than the first U-shaped leg means 212, i.e. the bight portion 246 of the first leg means 212 is shorter than the bight portion 246 of the second leg means 218. Thus, the first leg means 212 can nestle within the second leg means 218 when in the first resting position, i.e. adjacent the seat 224 when the device 210 is not in use.

Thus, as seen in FIG. 15, the device 210 can lie substantially flat when not in use. Furthermore, the bight portion 246 of the first leg means 212 is always entrapped by, but slidably disposed within, the race or races 256 formed by the recess 238 of the seat 224, and the plates 258. The race 256 is oriented generally parallel to the seat 224. The bight portion 246 of the U-shaped second leg means 218, pivots but otherwise is substantially prevented from moving in any other direction, thereby providing a pivotal connection means 264. Thus, the top portions of each leg means 212, 218 are contained by the attachment means 230 whether in the first resting position, the second resting position, or anywhere therebetween, as shown, for example, in FIG. 17. Thus, bottom portion 222 of the second leg means 218 may pivot away from the seat 224 from a resting position.

Figure 18:
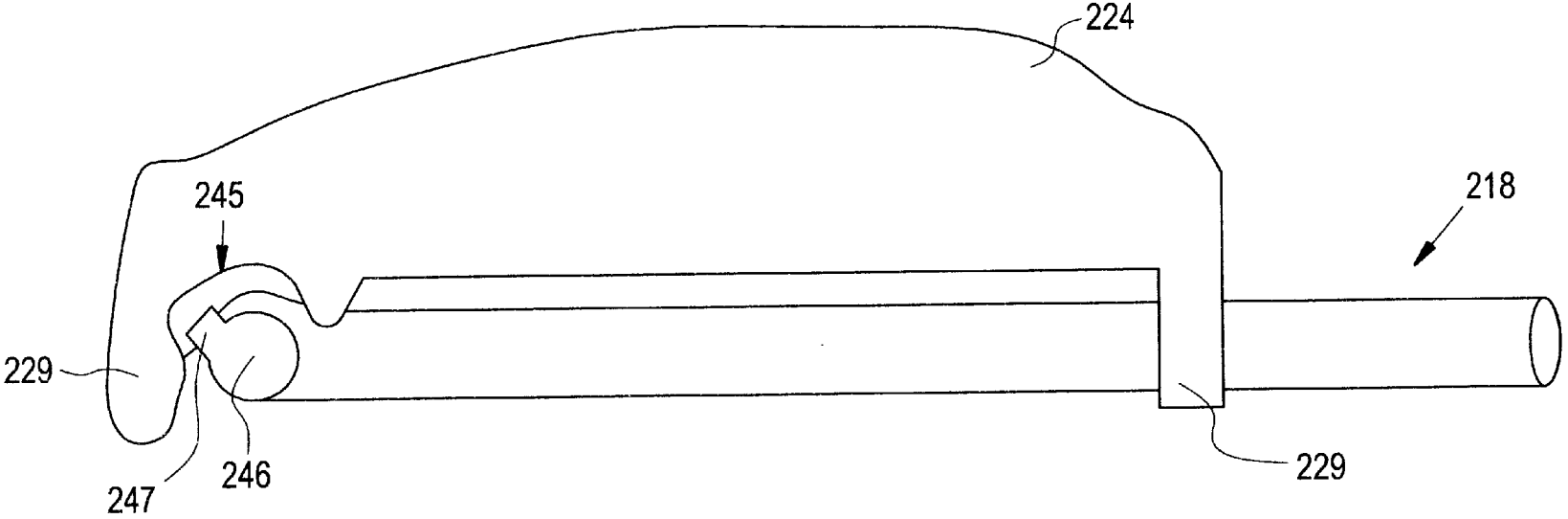
FIG. 18 is a cross-sectional cutaway side view of a part of one embodiment of the present invention.

FIG. 18 shows a cross-sectional cutaway side view of a part of one embodiment of the present invention, simplified to show the longitudinal recess 245 and the projection 247.

The foldable bench 210 may further comprise a backrest attached to the seat 224. Preferably, the backrest is pivotally attached to the seat 224.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A foldable bench comprising:

a first leg means having a top portion and a bottom portion;

a second leg means having a top portion and a bottom portion;

a seat having a top surface, a bottom surface, and attachment means for slidably attaching said top portion of said first leg means below said top surface of said seat and pivotally attaching said top portion of said second leg means below said top surface of said seat, so that said attachment means keeps said top portion of each of said leg means attached to said seat so that said top portion of each of said leg means does not separate from said seat when said first leg means pivots and said second leg means slides;

a backrest connected to the seat;

wherein said seat allows said first and second leg means to move between a first resting position and a second resting position;

wherein, in said first resting position, said first and second leg means are substantially disposed adjacent said seat; and wherein, in said second resting position, said first and second leg means generally crisscross each other and generally extend away from said seat.

2. The foldable bench according to claim 1 wherein said first and second leg means are pivotally attached to one another intermediate said top and bottom portions.

3. The foldable bench according to claim 1 wherein said seat further comprises a stop means disposed below said top surface of said seat for limiting the sliding movement of one of said leg means.

4. The foldable bench according to claim 3 wherein said stop means is disposed between said top and bottom surfaces of said seat.

5. The foldable bench according to claim 3 wherein said stop means is disposed substantially at said bottom surface of said seat.

6. The foldable bench according to claim 1 wherein said attachment means is disposed substantially at said bottom surface of said seat.

7. The foldable bench according to claim 1 wherein said attachment means is disposed between said top and bottom surfaces of said seat.

8. The bench according to claim 1 wherein said foldable bench further comprises a backrest attached to said seat.

9. The bench according to claim 8 wherein said backrest is pivotally attached to said seat.

10. The bench according to claim 8 wherein said backrest is adapted to move between a first resting position and a second resting position;

wherein, in said first resting position, said backrest is substantially disposed adjacent said seat;

wherein, in said second resting position, said backrest is substantially disposed away from said seat;

whereby said bench assumes a fully folded state when said backrest and said first and second pairs of legs are in said first resting position.

11. A foldable bench comprising:

a first leg means having a top portion and a bottom portion;

a second leg means having a top portion and a bottom portion;

a seat having a top surface, a bottom surface, and attachment means for slidably attaching said top portion of said first leg means below said top surface of said seat and pivotably attaching said top portion of said second leg means below said top surface of said seat, so that said attachment means keeps said top portion of each of said leg means attached to said seat in order that said top portion of each of said leg means does not separate from said seat when said first leg means pivots and said second leg means slides;

wherein said seat allows said first and second leg means to move between a first resting position and a second resting position;

wherein, in said first resting position, said first and second leg means are substantially disposed adjacent said seat; and wherein, in said second resting position, said first and second leg means generally criss-cross each other and generally extend away from said seat; and at least one of said first and second leg means comprises a substantially U-shaped leg member having a bight portion engaged by said attachment means.

12. The foldable bench according to claim 11, wherein said attachment means comprises at least one race disposed on said bottom surface of said seat, said race being adapted to allow at least a portion of said second pair of legs to slide therein between said first resting position and said second resting position.

13. The foldable bench according to claim 12, wherein said race is arranged substantially parallel to said bottom surface of said seat, so that said bight portion of said second leg means is prevented from movement substantially perpendicular to said bottom surface of said seat.

14. The foldable bench according to claim 13 wherein said seat further includes a stop means for stopping said first leg means from moving toward an outer periphery of said seat, and a ridge spaced apart from said stop means and being adapted to prevent translation of an upper portion of said second leg means toward said stop means.

15. A foldable bench comprising:

a seat having a top surface, a bottom surface, and a stop means disposed substantially on said bottom surface;

a backrest connected to the seat;

a first pair of legs slidably mounted to said bottom surface of said seat opposite said stop means;

a second pair of legs pivotally mounted to said bottom surface of said seat and pivotally attached to said first pair of legs, wherein said first and second pairs of legs are adapted to move between a first resting position and a second resting position;

wherein, in said first resting position, said first and second pairs of legs are substantially disposed adjacent said seat;

wherein, in said second resting position, said first and second pairs of legs generally criss-cross each other, said second pair of legs releasably engage said stop means, and said stop means substantially prevents said second pair of legs from moving in at least one direction;

whereby said bench assumes a folded state when said first and second pairs of legs are in said first resting position.

16. The bench according to claim 15 wherein said stop means substantially prevents said second pair of legs from moving toward the outer periphery of said seat.

17. The bench according to claim 15 wherein said seat further comprises at least one race disposed on said bottom surface of said seat, said race being adapted to allow at least a portion of said second pair of legs to slide therein between said first resting position and said second resting position.

18. The bench according to claim 17 wherein said race is arranged substantially parallel to said bottom surface of said seat, so that a bight portion of said second pair of legs is prevented from movement substantially perpendicular to said bottom surface of said seat.

19. The bench according to claim 15 wherein said stop means further comprises means for releasably locking said second pair of legs to said stop means.

20. The bench according to claim 19 wherein said releasable locking means further comprises at least one clamp.

21. The bench according to claim 19 wherein said releasable locking means further comprises at least one indentation formed in said stop means.

22. The bench according to claim 15 wherein said first pair of legs are attached to each other.

23. The bench according to claim 15 wherein said first pair of legs is integrally attached to each other.

24. The bench according to claim 15 wherein said first pair of legs further comprises a connecting portion which connects each of said first pair of legs.

25. The bench according to claim 24 wherein said first pair of legs has a substantially U-shape.

26. The bench according to claim 15 wherein said second pair of legs are attached to each other.

27. The bench according to claim 15 wherein said second pair of legs is integrally attached.

28. The bench according to claim 15 wherein said second pair of legs further comprises a connecting portion which connects each of said second pair of legs.

29. The bench according to claim 28 wherein said second pair of legs has a substantially U-shape.

30. The bench according to claim 15 wherein said foldable bench further comprises a backrest attached to said seat.

31. The bench according to claim 30 wherein said backrest is pivotally attached to said seat.

32. The bench according to claim 30 wherein said backrest is adapted to move between a first resting position and a second resting position;

wherein, in said first resting position, said backrest is substantially disposed adjacent said seat;

wherein, in said second resting position, said backrest is substantially disposed away from said seat;

whereby said bench assumes a fully folded state when said backrest and said first and second pairs of legs are in said first resting position.

33. The bench according to claim 15 wherein said stop means is a downwardly extending projection of said seat.

34. The bench according to claim 15 wherein said bottom surface of said seat is provided with a recess adapted to receive the top portions of said first and second pairs of legs.

35. The bench according to claim 15 further comprising means for preventing lateral movement of said second pair of legs with respect to said seat.

36. A foldable bench comprising:

a seat having a top surface, a bottom surface, and a stop means disposed substantially on said bottom surface;

a first pair of legs slidably mounted to said bottom surface of said seat opposite said stop means;

a second pair of legs pivotally mounted to said bottom surface of said seat and pivotally attached to said first pair of legs, wherein said first and second pairs of legs are adapted to move between a first resting position and a second resting position;

wherein, in said first resting position, said first and second pairs of legs are substantially disposed adjacent said seat;

wherein, in said second resting position, said first and second pairs of legs generally criss-cross each other, said second pair of legs releasably engage said stop means, and said stop means substantially prevents said second pair of legs from moving in at least one direction;

wherein said bench assumes a folded state when said first and second pairs of legs are in said first resting position;

wherein said stop means is a downwardly extending projection of said seat; and wherein said bottom surface of said seat further comprises a ridge spaced apart from downwardly extending projection and adapted to prevent translation of an upper portion of said second pair of legs.

37. A foldable bench comprising:

a seat having a top surface, a bottom surface, and a stop means disposed substantially on said bottom surface;

a first pair of legs slidably mounted to said bottom surface of said seat opposite said stop means;

a second pair of legs pivotally mounted to said bottom surface of said seat and pivotally attached to said first pair of legs, wherein said first and second pairs of legs are adapted to move between a first resting position and a second resting position;

wherein, in said first resting position, said first and second pairs of legs are substantially adjacent said seat, wherein, in said second resting position, said first and second pairs of legs releasably engage said stop means, and said stop means substantially prevents said second pair of legs from moving in at least one direction;

wherein said bench assumes a folded state when said first and second pairs of legs are in said first resting position; and said seat further comprises at least one race disposed on said bottom surface of said seat, said race being adapted to allow at least a portion of said second pair of legs to slide therein; and said race is delimited at an upper end by said bottom of said seat and at a lower end by a pair of longitudinal rods substantially parallel to said bottom of said seat.

* * * * *